US006234774B1

(12) United States Patent
Siviero

(10) Patent No.: US 6,234,774 B1
(45) Date of Patent: May 22, 2001

(54) COAXIAL VALVE-TYPE ALTERNATING PUMP ESPECIALLY FOR BOATS SUCH AS A RUBBER DINGHY, MANUALLY OPERATED OR MOTOR-DRIVEN

(76) Inventor: Roberto Siviero, Via Trivulzio 49, 27029 Vigevano (PV) (IT)

( * ) Notice: Subject to any disclaimer, the term of this patent is extended or adjusted under 35 U.S.C. 154(b) by 0 days.

(21) Appl. No.: 09/297,103

(22) PCT Filed: Jan. 20, 1997

(86) PCT No.: PCT/IT97/00011

§ 371 Date: Apr. 23, 1999

§ 102(e) Date: Apr. 23, 1999

(87) PCT Pub. No.: WO98/21476

PCT Pub. Date: May 22, 1998

(30) Foreign Application Priority Data

Nov. 11, 1996 (IT) ..... MI96A2327

(51) Int. Cl.[7] ..... F04B 39/10; F04B 53/10
(52) U.S. Cl. ..... 417/534; 92/256
(58) Field of Search ..... 417/234, 534, 417/535, 43, 286, 393, 415, 256; 92/256

(56) References Cited

U.S. PATENT DOCUMENTS 3,834,840 * 9/1974 Hartley ..... 417/535
4,009,971 * 3/1977 Krohn et al. ..... 417/43
4,097,199 * 6/1978 Dole et al. ..... 417/286
4,634,350 * 1/1987 Credle, Jr. ..... 417/393
4,931,000 * 6/1990 Fleming, Jr. ..... 417/534
5,244,364 * 9/1993 Laco et al. ..... 417/534
5,616,005 * 4/1997 Whithead ..... 417/46
5,626,072 * 5/1997 Mirand et al. ..... 92/256
5,762,480 * 6/1998 Adahan ..... 417/415

* cited by examiner

*Primary Examiner*—Teresa Walberg
*Assistant Examiner*—Leonid Fastovsky
(74) *Attorney, Agent, or Firm*—Michael J. Striker

(57) ABSTRACT

Pump (10) especially for a rubber dinghy and the like has a cylinder (11) with a double-acting alternating piston (13) and a small oblong cylinder (15) alongside the first, closed by heads (24) with packings (26), the valves (31) of the cylinder (11) communicating with the environment and the valves (19) of the small cylinder communicating with chambers (60, 61) that form at the ends of the cylinder (11) so that, on operating the piston (13) by an overgear with crank, an electric motor or the propulsor of a rubber dinghy, compressed air is generated and this passing through a centrally situated branch (33) in the cylinder (19), can be supplied to the rubber dinghy.

Figure 1:
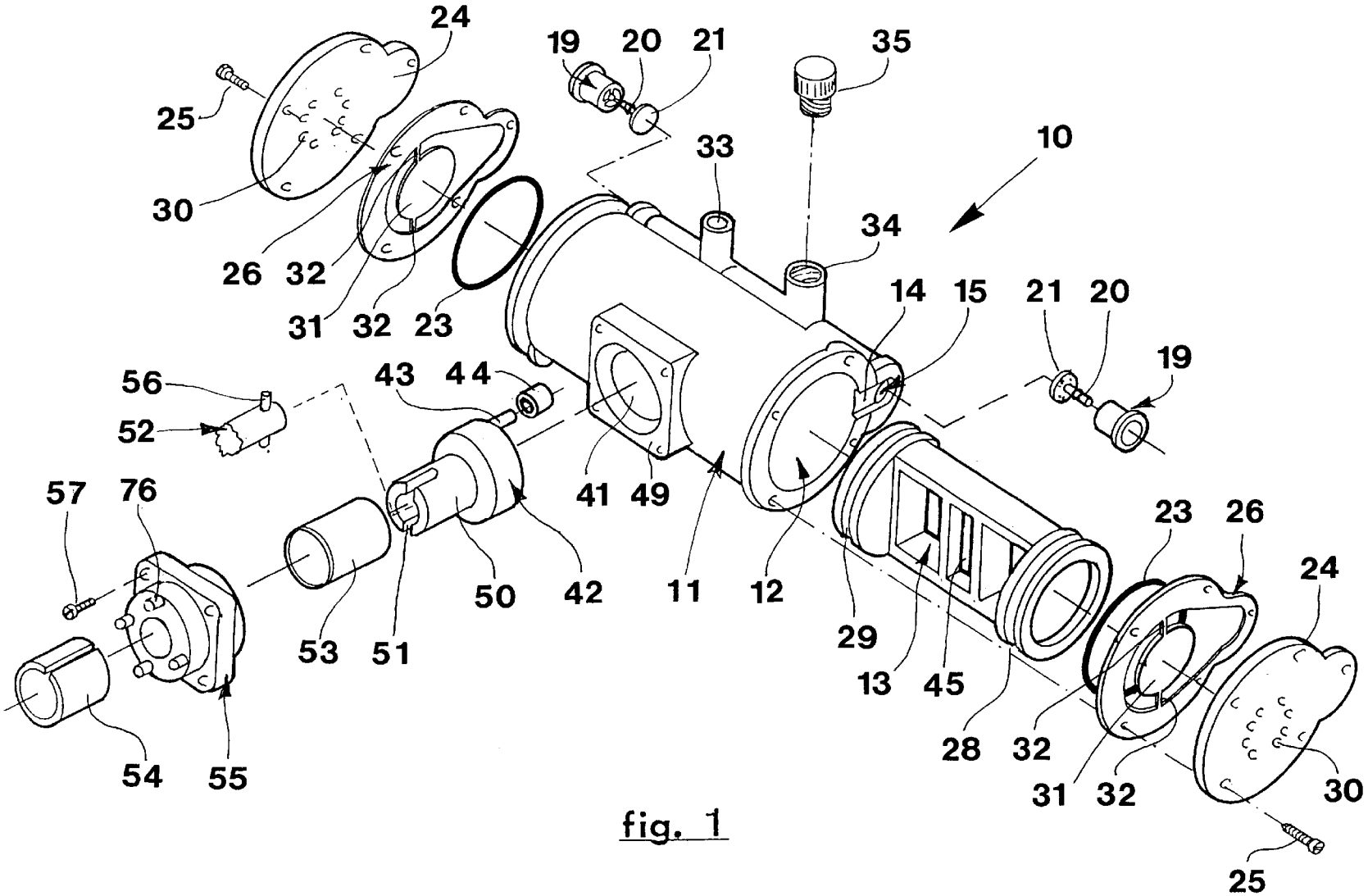

16 Claims, 4 Drawing Sheets fig. 4
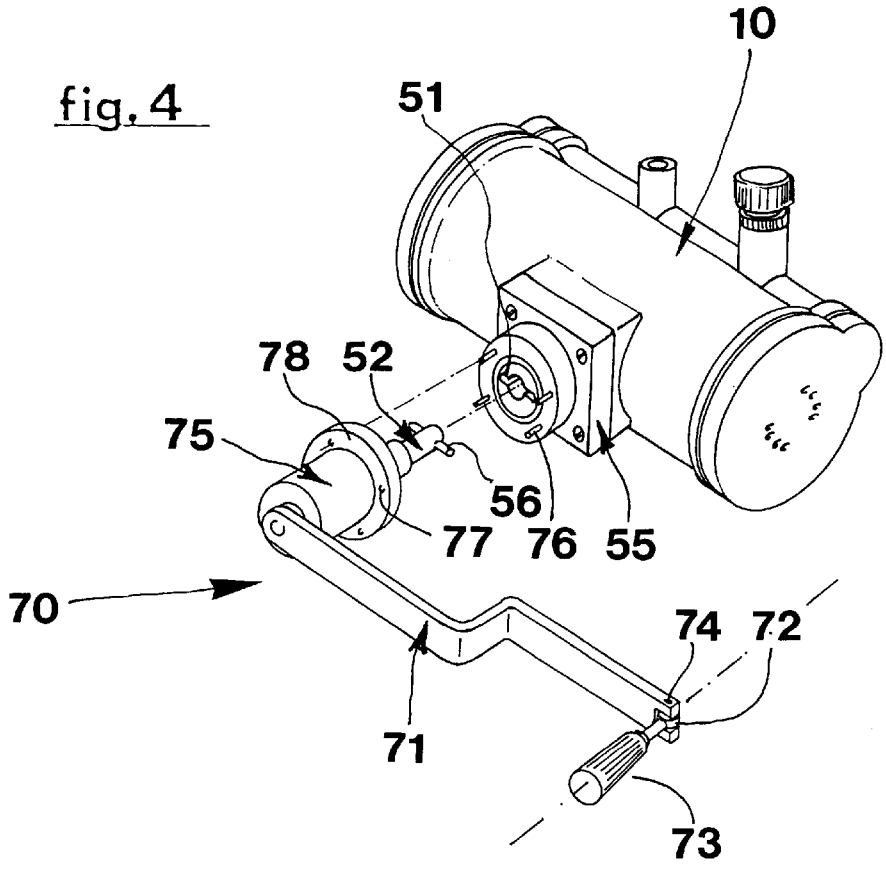
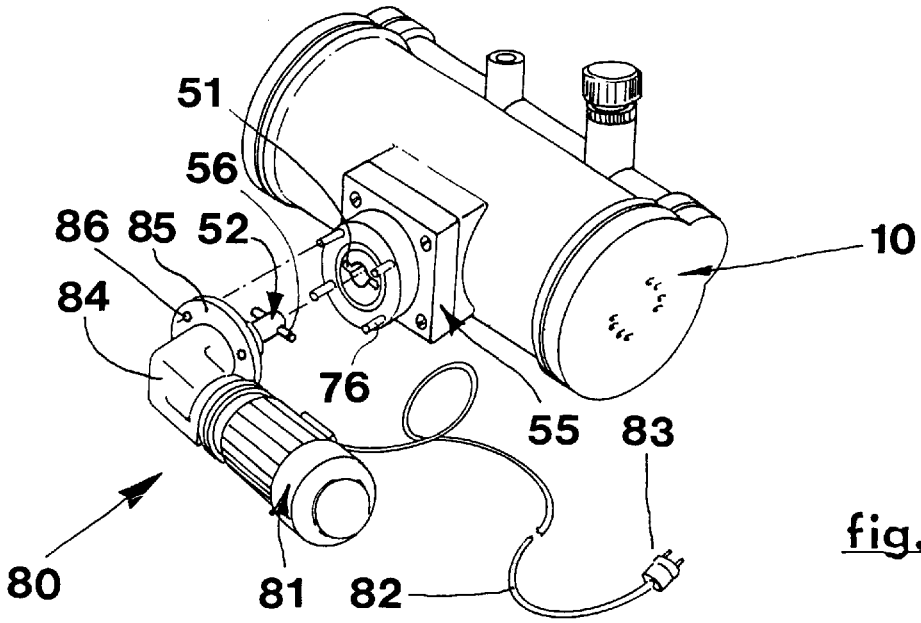
fig. 5

COAXIAL VALVE-TYPE ALTERNATING PUMP ESPECIALLY FOR BOATS SUCH AS A RUBBER DINGHY, MANUALLY OPERATED OR MOTOR-DRIVEN

BACKGROUND OF THE INVENTION

The invention concerns pumps for fluids generally.

The most widely used pumps for fluids are the double-acting type in which there is an alternating piston that, drawing in a fluid, simultaneously compresses the fluid drawn in during the piston's previous stroke made in the opposite direction.

These devices are usually complex and bulky because of the need for valves to permit entry of air and exit of compressed air at each stroke of the piston.

Elastic means of reaction are used to return the valves to their closed position and re-open them, in line with the action of the moving piston and create a cyclic distribution of the fluid at the desired pressure, quantities and delivery.

Especially in the nautical field where such wide use is made of inflatable rubber craft, the possibililty of rapidly inflating them with light simple and compact means is of decisive importance.

The chief advantage of having a rubber dinghy lies just in the fact of being able to turn an easily-stowed object like a deflated dinghy into a real boat, even of some considerable size.

The presently known hand-operated pumps are tiring to use; motor-driven ones are excessively bulky and expensive.

SUMMARY OF THE INVENTION

It is therefore clear that such pumps are for the most part unsatisfactory on account of their cost, weight and the difficulty of using them.

The present invention eliminates these problems by proposing a pump that offers many advantages such as lightness, compactness, long life and simplicity in use as will be explained below.

Subject of the invention is a double-acting pump expecially for types of inflatable rubber boats.

This pump has a main cylindrical body in which a piston slides, with end chambers closed by flat bodies that serve as heads and also as valves. Therefore, when the piston moves in one direction, the valve of the head left free automatically opens and the valve of the head which the piston approaches automatically closes, the effect being to produce suction in the chamber formed when the piston moves away and simultaneous compression in the chamber to which said piston is directed.

The opposite phenomena occur when the piston changes direction. The valves are formed of an elastic diaphragm adhering to the inner face of the head on an area perforated with holes through to the open air. The effect of suction automatically distorts the membrane drawing it into the chamber, detaching it from the air entry holes, while the effect of compression is to make the diaphragm adhere to the inner face of the head and so keep the valve closed.

Alongside the main cylindrical body and in one piece with it, is an oblong secondary cylindrical body similarly extending from one head of the pump to the other.

Apertures are made in the ends of said secondary cylindrical body for communication with the chambers formed in the main cylindrical body by movement of the piston.

Said ends of the secondry cylindrical body are closed by small cylindrical valves with inward-facing bases.

Said bases each have a set of holes passing through them and comprise inward-facing elastic diaphragms that adhere to the faces of said bases. Between the small valves on the secondry cylindrical body there is a branch for external connection.

Therefore, when suction is taking place in one chamber in the main cylindrical body, the valve on the secondary cylindrical body placed at the end connected with said chamber continues, due to the effect of suction, to remain closed by adherence of the diaphragm to the perforated base of the small valve concerned.

When, on the contrary, compression of air takes place, the compressed air, emerging through the holes in the small valve in the chamber where compression has been created, distorts the diaphragm drawing it away from the holes so permitting passage of compressed air inside the secondary cylindrical body and therefore, through the branch, distributing compressed air to the device needing it, such as a dinghy.

The geometrical form of the heads is obtained by association of the circle corresponding to the ends of the main cylinder with that corresponding to the ends of the secondary cylinder thus making said form that of a circular plate with a lateral semicircular expansion of constant width.

The piston exhibits two symmetrical discoid ends with an annular space for seal washers and, substantially central, a parallelepiped chamber of a constant rectangular section, transversal to the axis of the piston and open to the outside.

Said chamber houses a small button on a crank that freely turns on a rotor supported by the main cylindrical body substantially on its transversal axis of symmetry.

The two discoid ends of the piston are connected by an axial body whose diameter is considerably smaller than that of said ends thus permitting the rotor to fit into a part of the main cylindrical body between the chambers created on either side during the relative stages of suction.

Said rotor and crank partly emerge from the pump's main cylinder. At its rear end the crank has a cylindrical shank with diametral slits in it, communicating with the outside of the pump by an axial hole in the support of said crank.

Said crank can therefore be rotated by a means of propulsion with a coupling comprising a central cylindrical core able to penetrate inside said crank and a diametral bar whose ends can penetrate inside the slits.

Said means of propulsion can be a device with an overgear in which is an axial seat for receiving the coupling able to match with the shank of the internal crank that can be operated by a manual crank.

At the free end of said manual crank is a handgrip parallel to the axis of the overgear but rotatable around a transversal axis so as to permit the handgrip to be bent back towards the pump thus considerably lessening bulk when out of use or during transport.

The means of propulsion can be an electric ratiomotor, an ordinary electric drill, the propelling means of the boat itself.

All these means of operating must permit application of the coupling with cylindrical core and transversal bar for insertion into the shank of the internal crank acting on the piston.

There is a branch in the secondary cylindrical body for a calibrating valve that permits air to flow out automatically when a certain level of pressure is exceeded.

The diaphragms on the small valves in the secondary cylindrical body are of a size and made of a material that, if calibrated pressure is exceeded, they start to vibrate and emit a warning hiss.

Practically all the components of the pump are of plastic material, a few being of stainless steel to permit air, water and fluids generally to be pumped.

The valves of the heads are formed of a flat annular diaphragm comprising a central disk connected to the annular part by two diametral tongues.

The small valves inserted at the ends of the secondary cylindrical body are made from a cylinder in whose base is a central hole into which fits the shank of a valve with a plate lying towards the inside of said secondary cylindrical body and with a set of holes made round the central hole.

Diameter of the plate on the small valve is greater than the geomentrlc circumference externally tangential to the set of holes.

The invention offers evident advantages.

A pump is obtained by means of the head-valves that close the two ends of the main cylindrical body and the small valves at the ends of the secondary cylindrical body alongside and parallel to the main cylindrical body, said pump being exceptionally compact and of minimum bulk.

The special and extremely simple flat valves, made of silicon diaphragms that also act as packing for the heads, ensure deficient operation even though the pump is so extremely compact.

The possibility, provided by the coupling with its cross bar, of using almost any type of propulsor, from a hand-operated overgear to a ratiomotor or an ordinary electric drill or even the propulsor of a boat especially of a rubber dinghy, facilitates use of the pump accentuating its practical and rational features.

The simple nature of the various parts and adoption of practically indestructable and very light materials ensure almost unlimited life even though costs of materials and assembly are exceptionally low.

Characteristics and purposes of the invention will be made still clearer by the following examples of its execution illustrated by diagrammatically drawn figures.

FIG. 1 Exploded view of the pump, in perspective.

Figure 2:
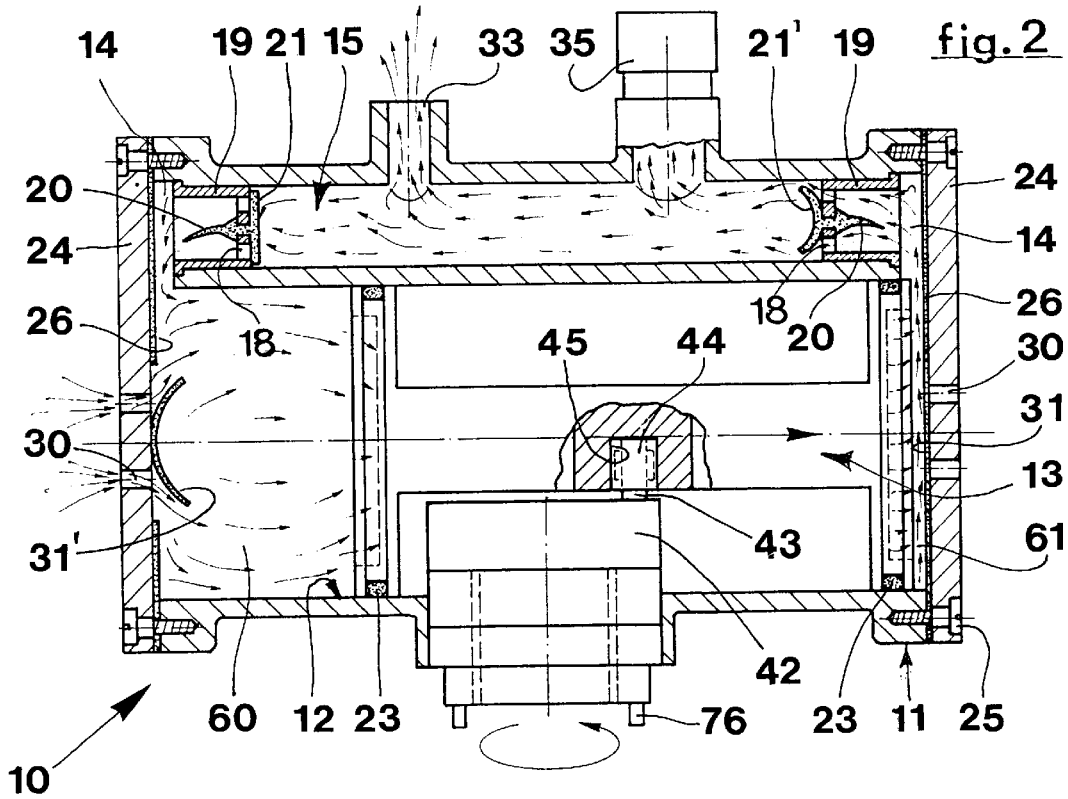

FIG. 2 The pump showing the piston at the end of its stroke, longitudinal section.

Figure 3:
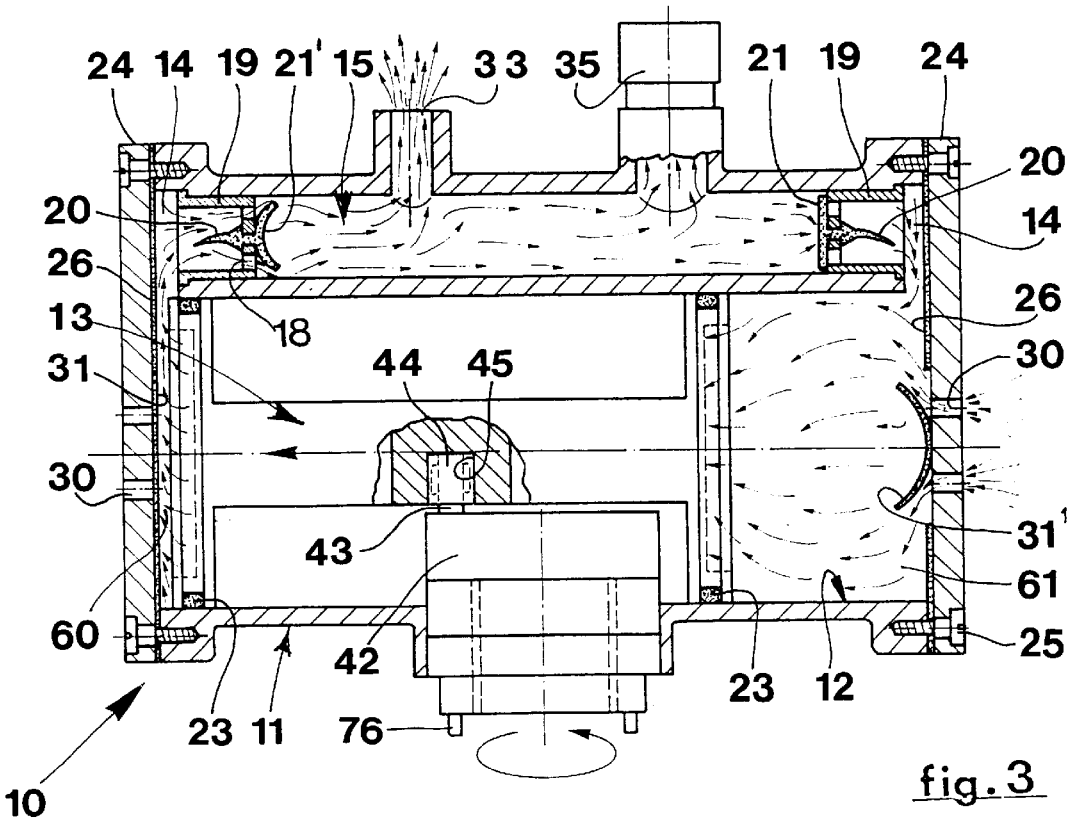

FIG. 3 As above with the piston at the end of its opposite stroke.

FIG. 4 The pump for manual operation, in perspective.

FIG. 5 The pump when worked by a ratiomotor, in perspective.

Figure 6:
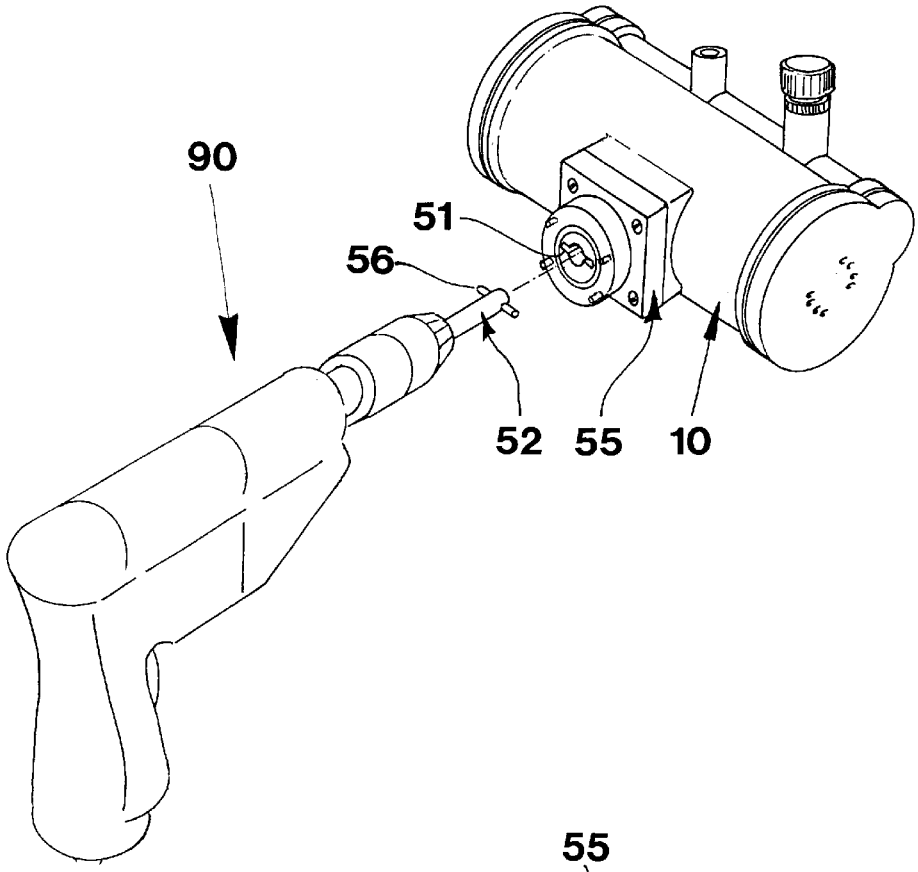

FIG. 6 The pump operated by an ordinary drill, in perspective.

Figure 7:
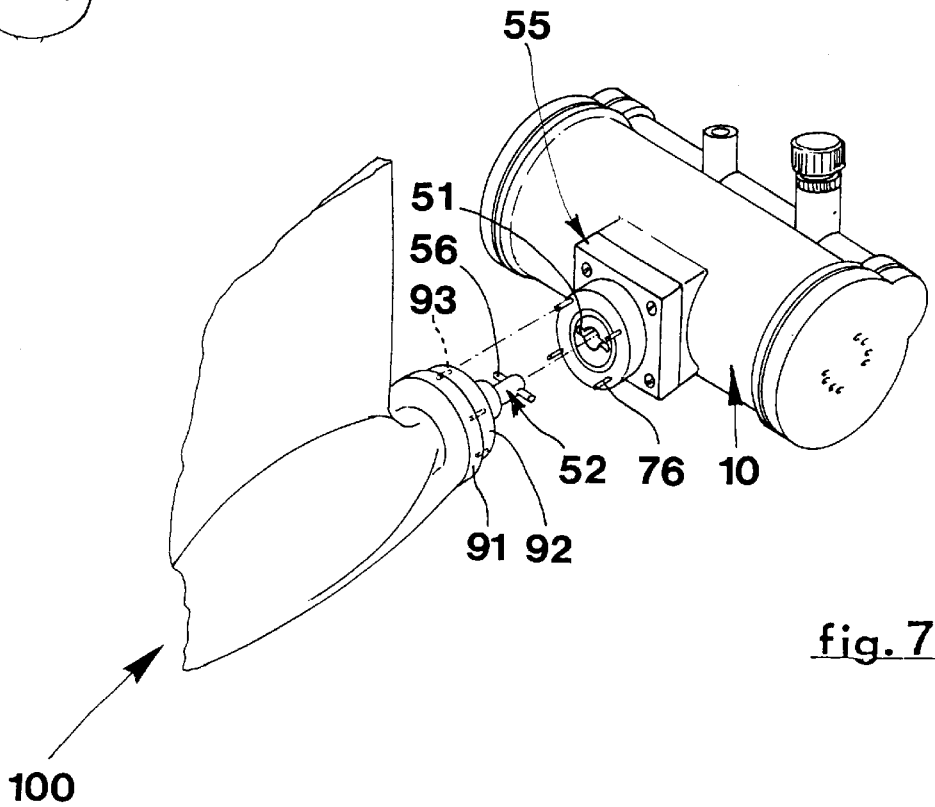

FIG. 7 The pump operated by the propulsor of a boat, in perspective.

The pump 10 is composed of a main cylindrical body 11 with internal space 12 in which slides the piston 13.

Said space 12 communicates, through the branch 14, with the secondary oblong cylinder 15 placed side by side, housing at its ends a pair of valves 19 with plate 21 and shank 20, of rubber.

At the two ends 28, 29 of the piston 13 are seal packings 23.

The cylindrical body 11 is closed at its two ends by the heads 24 screwed on by the screws 25.

Said heads exhibit sets of holes 30 placed round a circumference coaxial with the pump and are served by the seal-valves 26, 31 comprising the central disk-shaped circular diaphragm 31 fixed to the body of the disphragm itself by two diametral tongues 32 whose diameter is greater than the geometrical circumference externally tangential to said holes 30.

Branch 33 for distribution of compressed air and branch 34 for a calibrating valve 35 depart from said oblong secondary cylindrical body (15). Said valve controls pressure of pumped air from 0,25 to 1,5 atms.

When the set pressure value is exceeded the plate 21 on the valve 19 begins to vibrate producing a warning hiss.

At approximately the centre of the wall in the cylindrical body 11 of the pump there is a quadrangular raised seat 49 with a large hole 41 in it communicating with the inside of the cylindrical body 11.

To this seat the head 55 is applied by bolts 57 forming a cylindrical housing for a rotor 42 comprising a button of a crank 43 with bushing 44. At the rear of said rotor 42 is a shank 50 with diametral slits 51 in it to receive a coupling 52 formed of a cylindrical rod with cross bar 56 and ends made for insertion in the slits 51.

Said shank 50 fits inside the steel bushing 53 which in turn revolves inside another bushing 54.

On applying the head 55 to the seat 49 in the cylindrical body 11 of the pump, the off-centre pin 43 with button 44 penetrates inside the central transversal seat 45 of the piston 13.

Said seat 45, orthogonal to the axis of the piston, permits the button 44 to slide freely and therefore, due to rotation of the rotor 42, the piston 13 is compelled to make its alternating movement inside the cylindrical body 11 of the pump.

The parts of the pump are obtained from plastic castings while the elastic parts, such as the diaphragms of the valves, are of silicon.

As will appear from FIGS. 2 and 3, the alternating movement of the piston 13, due to the effect produced by rotation of the rotor 42, alternately forms chambers 60, 61 at one end and at the other of the space 12 inside the cylindrical body 11 of the pump. The pump functions as follows.

When the piston 13 has assumed the position seen in FIG. 2, it has drawn in air from outside into the chamber 60 through the holes 30 left free by the discoid diaphragm, indicated by 31', and at the same time has sent the previously drawn in air into the chamber 61 from where, through branches 14 and by opening of the plate 21, indicated by 21', of the valve 19, it passes inside the secondary oblong cylinder 15 and is supplied to the means requiring it through branch 33.

When the piston resumes its alternate stroke to reach the configuration in FIG. 3, the same phenomena take place but in the opposite direction and therefore air from outside is drawn in through the holes 30 left free by the disk-shaped diaphragm marked 31', in the chamber 61, and compression is made in the chamber 60 of the air already inside which is then transferred in compressed form through the plate 21' of the valve 19, open inside the oblong secondary cylinder 15, and distributed to the device being supplied through the branch 33.

In the meantime the valve 19 has closed because of air pressure inside the oblong secondary cylinder 15 since the two valves 19 oppose each other as do similarly the elastic disks 21.

The washers 23 in the annular seats of the end expansions 28, 29 of the piston 13, ensure a seal for the chambers 60, 61 that are alternately formed inside the main cylindrical body 11.

Rotation of the rotor 42 by means of the coupling 52 with cross bar 56 that penetrates inside the slits 51 in the shank 50 of said rotor 42, can be determined in various ways.

FIG. 4 shows a manual device 70 with an overgear 75 held to the head 55 on the body of the rotor 42 by the flange 78 and pins 76 passing through the holes 77. The overgear 75 exhibits a bent crank 71 with a forked end 72 that supports a handle 73 free to rotate round its own axis and round the pin 74 orthogonal to the shaft of said overgear 75. The coupling 52 with cross bar 56, that penetrates inside the slits 51 in the rotor 42, is applied to said overgear.

On rotating the crank 70 using the handle 73, the rotor 42 rotates by means of the overgear 75 this in turn causing the piston 13 to make its alternating movement and operate the pump as described.

FIG. 5 illustrates the pump driven by the electric ratio-motor 81 with cable 82 and plug 83 for electric feed, by means of an elbow-bent body 84 and small flange 85.

Said small flange 85 is fixed to the head 55 of the rotor 42 by the pins 76 that pass through holes 86.

The coupling 52, for insertion in the rotor 42, is applied to the ratio motor 80.

FIG. 6 shows how the pump can be worked by an ordinary drill 90, either battery-operated or fed from the mains, to which the coupling 52 is fixed.

In FIG. 7 the pump is motor-driven by the propulsor 100 of a boat. The locking ring 92, with four holes 93 to allow passage of the pins 76 for connection to the rotor 42, is fitted onto the hub 91 of said propulsor. The coupling 52 is fixed to the propulsor.

What is claimed is:

1. A double-acting pump, especially for use with a rubber dinghy, comprising a main cylindrical body (11) having an internal volume (12), a piston (13) which slides in said internal volume, and end chambers (60, 61) closed by flat bodies, said flat bodies comprising heads (24), each head including a seal-valve (31, 26) and an internal face with holes that communicate with the atmosphere, such that movement of the piston in one direction automatically causes opening of the valve (31) in the head from which the piston is moving away, and closure of the valve (31) in the head which the piston is approaching, which produces suction in the chamber (60, 61) created by departure of the piston and simultaneous compression in the chamber (60, 61) which the piston is approaching, suction and compression being reversed when the piston changes direction, each said valve comprising an elastic diaphragm which adheres to the internal face of the head in an area in which the holes (30) in said head communicate with the atmosphere, the suction distorting the valve (31) and pressing it away from the internal face of the head, causing it to free the holes (30), and open the valve for entry of air, and compression causing the valve to adhere against the internal face of the head to keep said valve closed.

2. A double-acting pump as in claim 1, further comprising an oblong secondary cylindrical body (15) located in an internal side portion of the main cylindrical body (11) and extending between the heads (24) of the pump (10), apertures (14) located in the ends of said secondary cylindrical body (15) being in communication with said chambers (60,61), each end of the secondary cylindrical body (15) being closed by a small cylindrical valve (19) with an inward-facing base (21) having a face with a set of holes (18), said base comprising an elastic discoid diaphragm that adheres to the face of said inward-facing base in the secondary cylindrical body (15), a fitting (33) being placed between the small valves (19) through which communication is made with an output, so when suction takes place in the chamber (60, 61) the valve (19) in the second cylindrical body (15) is affected by said suction and the discoid diaphragm (21) continues to remain closed to the perforated base of said valve (19), while when compression takes place, the compressed air emerges through the holes (18) in the small valve (19) in the chamber (15), and causes distortion of the diaphragm (21), detaching it from the holes and allowing compressed air to pass inside the secondary cylinder body (15) from where, through the fitting (33), said compressed air is distributed to an output.

3. A double-acting pump as in claim 1, wherein the heads (24) have a geometrical form obtained by association of the circle corresponding to the ends of the main cylinder (11) with the circle corresponding to the ends of the secondary cylinder (15) so that said heads (24) are formed of a circular plate that exhibits a semi-circular lateral expansion.

4. A double-acting pump as in claim 1, wherein the ends of the piston (13) exhibit two symmetrical discoid expansions (28,29) with annular seats containing sealing washers (23) and a substantially central, outwardly opening parallelepiped chamber (45) of rectangular shape and transverse to the axis of the piston, said chamber (45) housing a button (43) of a crank of a rotor (42) supported by a quadrangular protuberance (49) in the main cylindrical body (11) at a position substantially transverse to an axis of symmetry of the cylindrical body.

5. A double-acting pump as in claim 4, wherein the piston (13) connects the two discoid expansions (28,29) by means of an axial body whose diameter is considerably smaller than that of said expansions, so as to accept a housing of the rotor (42) in a central area of the main cylindrical body during the stages of suction and compression.

6. A double-acting pump as in claim 5, wherein the rotor (42) has a cylindrical shank (50) with diametrical slits (51), said shank being rotated through an axial hole in the rotor (42) by propulsion means (70,80,90,100) provided with a coupling (52), said coupling comprising a cylindrical core and a cross bar (56), the ends of said cross bar being positioned inside the slits (51).

7. A double-acting pump as in claim 1, wherein the pump (10) is operated by a manual device (70) comprising an overgear (75) that provides an axial fixing means for the coupling (52) with a cross bar (56) and a manual crank (71) attached to the shaft of said overgear (75), a handgrip (73) being parallel to the axis of overgear (75), and a transversal axis (74) so that said handgrip (73) can be folded back toward the pump during transportation.

8. A double-acting pump as in claim 6, wherein the pump is operated by an electric ratio-motor (80) with an axial fixing means for the coupling (52).

9. A double-acting pump as in claim 6, wherein the pump is operated by an ordinary electric drill (90) to which the coupling (52) is attached.

10. A double-acting pump as in claim 1, wherein the pump is operated by the propulsor of a boat (100) into which the coupling is fitted.

11. A double-acting pump as in claim 1, wherein a branch (34) of a calibrating valve (35) is inserted in the body of the secondary cylinder, said valve permitting an automatic release of air when a certain level of pressure is exceeded.

12. A double-acting pump as in claim 2, wherein size and material of the discoid diaphragm (21) in the small valves (19) in the secondary cylindrical body (15) are such that when a set pressure level is exceeded the diaphragm and the valves begin to vibrate and produce a warning hiss.

13. A double-acting pump as in claim 2, wherein the main cylindrical body (11) and the secondary cylindrical body (15) are made in one piece.

14. A double-acting pump as in claim 1, wherein components of the pump (10) are substantially made of either plastic or stainless steel material, so as to permit use for pumping air water, or other fluids.

15. A double-acting pump as in claim 1, wherein the valves (31) of the heads (24) are formed of a central discoid area of the flat annular diaphragm (26), which also functions as packing, connected to said diaphragm by two diametrical tongues (32).

16. A double-acting pump as in claim 2, wherein each of the small valves (19) is formed of a small cylinder with a central hole in its base, which receives the shank (20) of a valve (19) with a plate (21) facing towards the inside of said secondary cylindrical body (1 5) and a set of holes (18) perforated round the central hole, the diameter of said plate (21) being greater than the geometrical circumference that externally surrounds the set of holes.

* * * * *